United States Patent [19]

Iwata et al.

[11] Patent Number: 4,908,661

[45] Date of Patent: Mar. 13, 1990

[54] HOLDER DEVICE FOR HANDLING AN IMAGE CARRIER OF AN IMAGE FORMING APPARATUS

[75] Inventors: Nobuo Iwata, Sagamihara; Koji Sakamoto, Tokyo; Misao Tanzawa, Kawasaki, all of Japan

[73] Assignee: Ricoh Company, Ltd., Tokyo, Japan

[21] Appl. No.: 268,890

[22] Filed: Nov. 8, 1988

[30] Foreign Application Priority Data

| | | | |
|---|---|---|---|
| Nov. 27, 1987 | [JP] | Japan | 62-297783 |
| Nov. 27, 1987 | [JP] | Japan | 62-297784 |
| Jun. 9, 1988 | [JP] | Japan | 63-140511 |

[51] Int. Cl.[4] ..... G03G 15/00

[52] U.S. Cl. ..... 355/211; 355/210

[58] Field of Search ..... 355/211, 212, 213

[56] References Cited

U.S. PATENT DOCUMENTS

| | | | |
|---|---|---|---|
| 4,114,998 | 9/1978 | Shimizu et al. | 355/211 X |
| 4,478,507 | 10/1984 | Miyoshi et al. | 355/211 |
| 4,527,883 | 7/1985 | Kamiyama | 355/211 |
| 4,674,858 | 6/1987 | Nagayama | 355/211 |
| 4,708,455 | 11/1987 | Kubota et al. | 355/211 |

*Primary Examiner*—A. C. Prescott

*Attorney, Agent, or Firm*—Oblon, Spivak, McClelland, Maier & Neustadt

[57] ABSTRACT

A holder device for handling a replaceable image carrier of an image forming apparatus. A photoconductive element mounted in an electrophotographic copier or similar apparatus and to which toner adheres can be dismounted and replaced with a new photoconductive element with ease and without touching it. A box-like holder has receiving sections for accommodating the old and new photoconductive elements individually. The receiving sections are each provided with guide slots for grasping and guiding opposite ends of a shaft on which a photoconductive element is mounted and openings each being contiguous with a respective one of the guide slots, said guide slots and openings being formed through each of opposite end walls of a housing of the holder device. Lugs are provided on the end walls of the housing to cancel the restraint of restraining members which prevent the ends of a shaft of a photoconductive element from slipping out of the copier, as the holder is sequentially moved into the copier.

24 Claims, 18 Drawing Sheets

HOLDER DEVICE FOR HANDLING AN IMAGE CARRIER OF AN IMAGE FORMING APPARATUS

BACKGROUND OF THE INVENTION

The present invention relates to a holder device for handling an image carrier which is included in an image forming apparatus.

In an electrophotographic copier, laser printer, facsimile apparatus or similar image forming apparatus, a toner image is formed on an image carrier such as a photoconductive element and then transferred to a paper sheet. It is necessary for the image carrier to be mounted on the body of the image forming apparatus during the course of production. Moreover, since the image carrier deteriorates due to aging, it has to be replaced with a new image carrier from time to time. In addition, it often occurs that the image carrier must be removed from the apparatus body for picking out a jamming paper sheet, for example, and again mounted on the apparatus body after the removal of the jamming paper sheet.

When the image carrier is to be removed from the apparatus body for any of the purposes stated above, directly touching the surface of the image carrier is undesirable because toner adhered to that surface would smear the operator's hands and clothes. At the least, the image carrier to be removed from the apparatus body needs to be handled with special care so that its surface may be protected from external objects which would scratch or otherwise damage the surface, and so must be kept away from hands. This is also true when the image carrier is to be mounted on the apparatus body.

Traditionally, therefore, the operations for mounting and dismounting an image carrier have been left to the care of a serviceman. However, a current trend is toward a miniature image forming apparatus such as a miniature copier for personal use in which a user is expected to replace an image carrier without the help of a serviceman. To allow an ordinary user to readily mount and dismount an image carrier or photoconductive element, there has been proposed a process kit in which the photoconductive element and various units associated therewith, such as a developing unit and a cleaning unit are assembled together, as disclosed in Japanese Laid-Open Patent Publication (Kokai) Nos. 62-170978 (Canon) and 51-2433 (Minolta). Since such a process kit is bodily replaceable with another, a person does not have to directly touch the photoconductive element and is prevented from damaging the same when mounting it.

A problem with the process kit scheme stated above is that even when the service life of only one of the units installed in the process kit, or that of the image carrier only, exires, the entire process kit has to be replaced with another at high cost. Another prior art technique for facilitating the handling of an image carrier is to provide the image carrier with a grip, as shown and described in Japanese Laid-Open Utility Model Publication No. 61-201054 (Canon) by way of example. This solution has a drawback in that the grip is a hinderance once the image carrier is loaded in the apparatus body for operation. Moreover, a person may still touch the surface of the image carrier, intentionally or not, despite the presence of the grip.

SUMMARY OF THE INVENTION

It is therefore an object of the present invention to provide a holder which allows a person to easily mount and dismount an image carrier from the body of an image forming apparatus without touching the image carrier.

A holder device for handling an image carrier which is used with an image forming apparatus of the present invention comprises a housing defining a space for accommodating the image carrier and provided with an open portion for mounting and dismounting the image carrier from the space, and image carrier support means provided on the housing for detachably supporting the image carrier when the image carrier is accommodated in the housing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
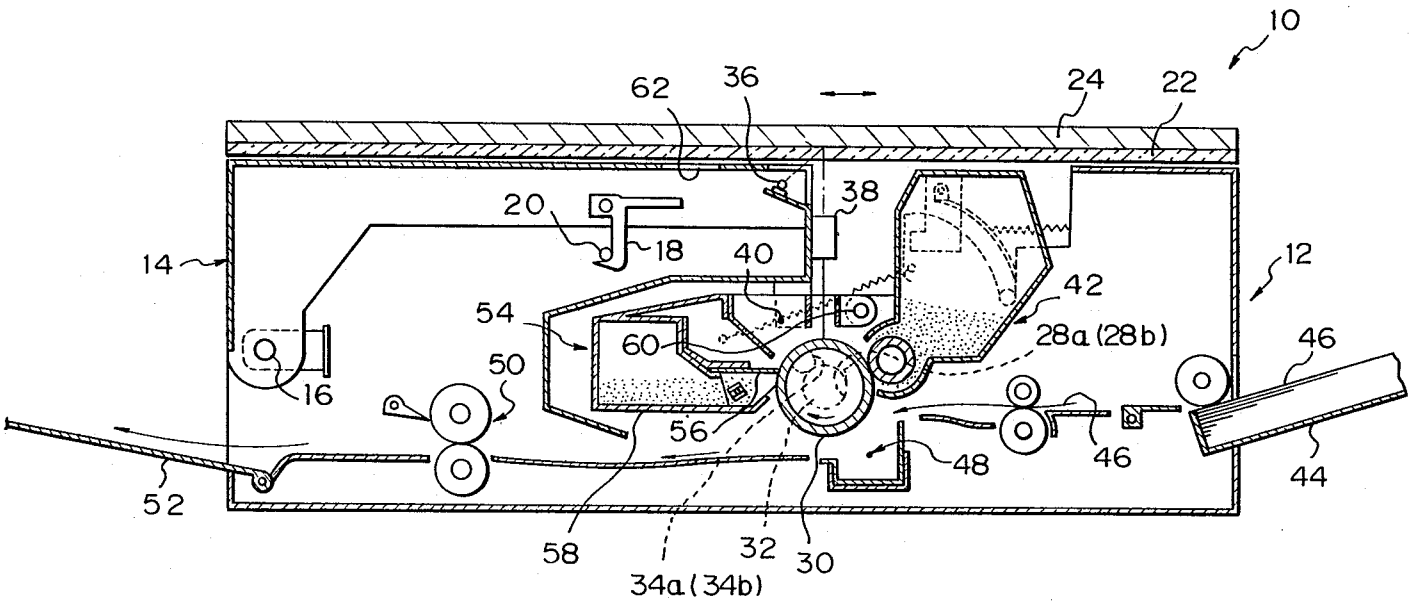
FIG. 1 is a section showing the general construction of an electrophotographic copier representative of image forming apparatuses to which the present invention is applicable.

To better understand the present invention, a brief reference will be made to the general construction of an electrophotographic copier to which the present invention is applicable, shown in FIG. 1. It is to be noted that the electrophotographic copier merely represents a family of image forming apparatuses known in the art. A copier having substantially the same construction as the copier of FIG. 1 is disclosed in pending U.S.patent application Ser. No. 07/163,027, filed Mar. 2, 1988 by Misao Tanzawa et al.

Figure 2:
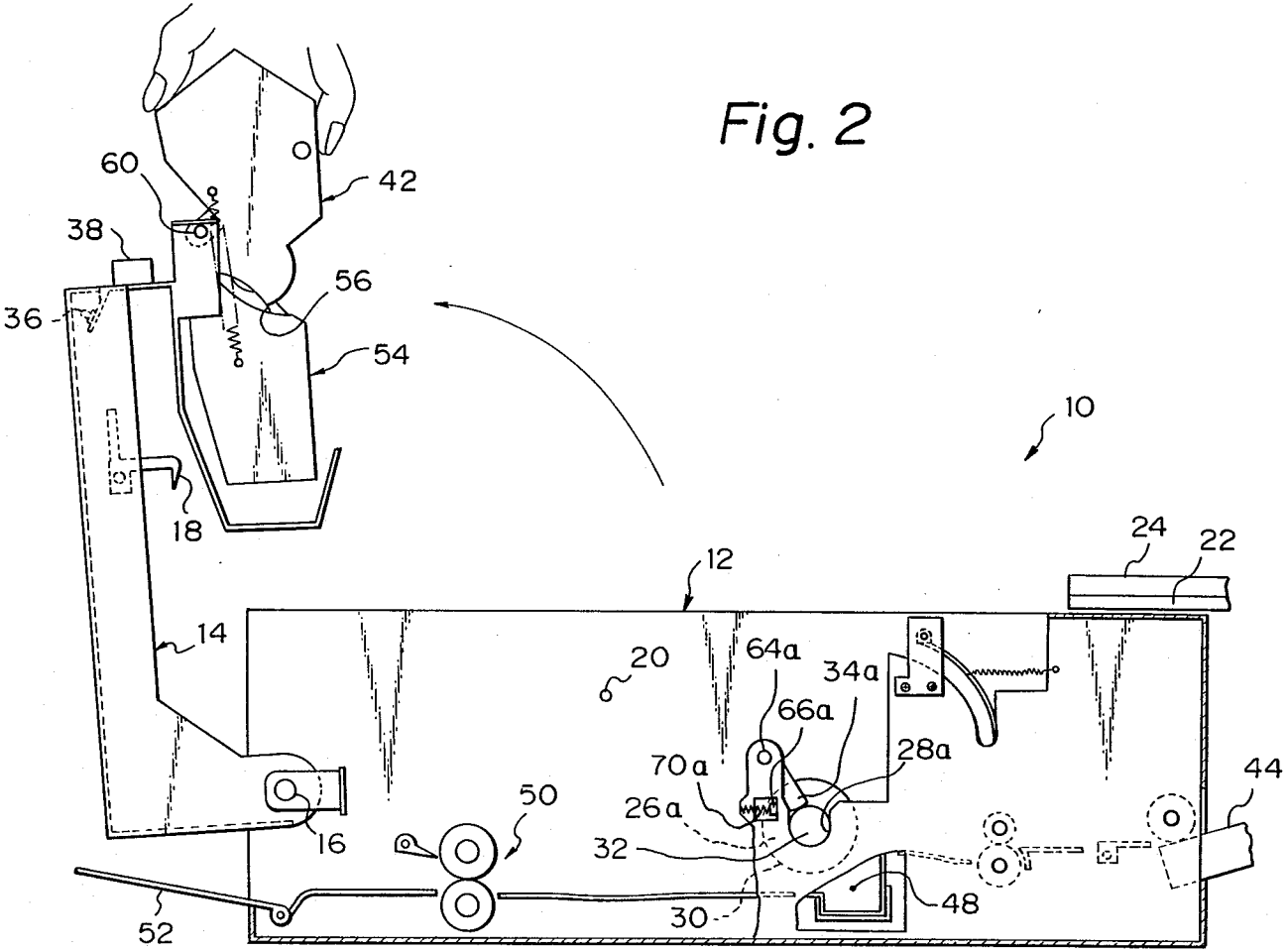
FIG. 2 is a section of the copier taken at a position closer to the viewer the section of FIG. 1.
Figure 3:
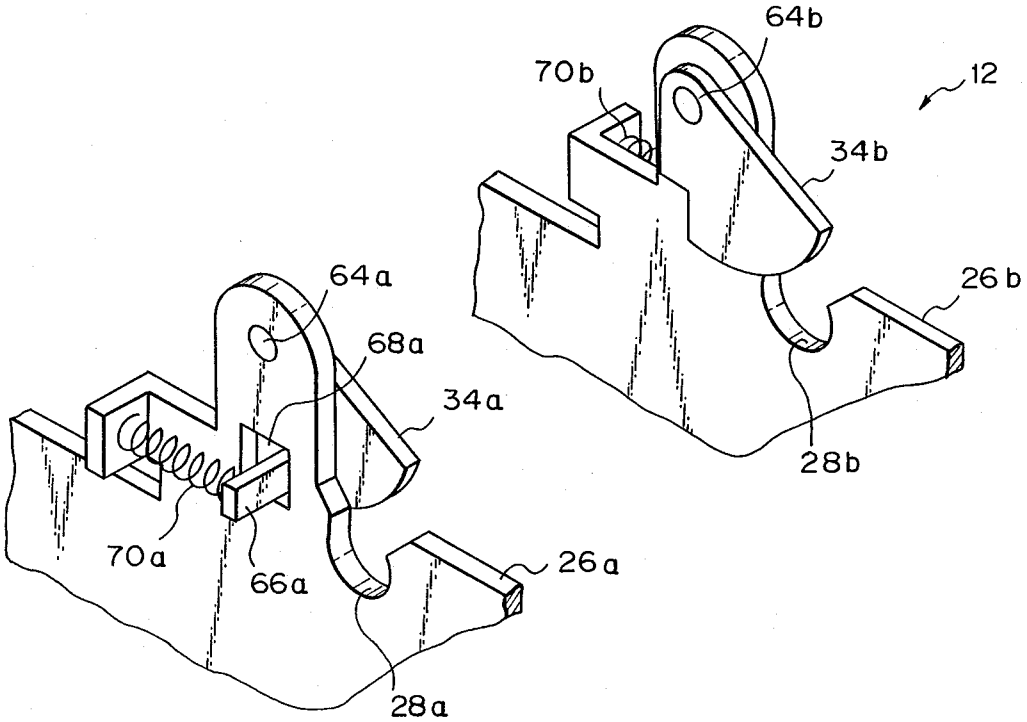
FIG. 3 is a perspective view showing latches which serve as restraining means and a structure associated with the latches.

As also shown in FIG. 2, the copier, generally 10, is made up of a lower assembly 12 and an upper assembly 14 which is rotatably mounted to the casing of the lower assembly 12 by a pin 16. A pawl 18 is pivotally mounted on the upper assembly 14 while a pin 20 is studded on the casing of the lower assembly 12. Usually, the upper and lower assemblies 14 and 12 are locked to each other with the pawl 18 and pin 20 mating with each other. A glass platen 22 is supported on the top of the lower assembly 12 in such a manner as to be movable in a horizontal reciprocating motion. A document, not shown, is laid on the glass platen 22 and pressed from above by a cover plate 24. As shown in FIG. 3, a front support plate 26*a* and a rear support plate 26*b* are provided with aligned recesses 28*a* and 28*b*, respectively. A photoconductive element 30 in the form of a drum and representative of an image carrier is mounted on a shaft 32 which is in turn rotatably received in the recesses 28*a* and 28*b* at opposite ends thereof. Latches 34*a* and 34*b* are provided for preventing the shaft 32 from slipping out of the recesses 28*a* and 28*b*, as described in detail later.

In operation, the glass platen 22 loaded with a document is moved horizontally in the position shown in FIG. 1 while, at the same time, a light source 36 mounted on the upper assembly 14 illuminates the document. Imagewise light reflected by the document is focused onto the surface of the drum 30 by a lens array 38 which is also mounted on the upper assembly 14, the drum 30 being rotated clockwise. The surface of the drum 30 is uniformly charged to a predetermined polarity by a charger 40 beforehand, so that a latent image associated with the document is electrostatically formed on the drum 30. The latent image is developed by toner which is supplied from a developing unit 42 to become a toner image. A sheet cassette 44 is mounted on the lower assembly 12 to feed paper sheets 46 one by one toward the drum 30. The toner image on the drum 30 is transferred to the paper sheet 46 by a transfer charger 48 which is supported by the lower assembly 12. The paper sheet 46 carrying the toner image is fed to a fixing unit 50 to fix the toner image thereon and then driven out of the copier 10 to a copy tray 52. Toner remaining on the drum 30 after such transfer of the toner image is scraped off by a cleaning blade 56 of a cleaning unit 54 and collected in a cleaning case 58. The cleaned surface of the drum 30 is discharged by a discharger, not shown.

The developing unit 42 and the cleaning unit 54 are pivotally connected together by a pin 60 to constitute a unitary process kit. This process kit is removably mounted on the upper assembly 14. The charger 40 is also assembled integrally with the process kit.

The drum 23 may be removed from the lower assembly 12 by the following procedure when the life of the drum 23 has expired, when a paper sheet has jammed a path below the drum 30, or when the lower assembly 12 needs some repair. First, the glass platen 22 and cover plate 24 are moved to the right, as shown in FIG. 2. Then, a finger is inserted into a window 62 (FIG. 1) which is formed through the rotatable upper assembly 14 so as to release the pawl 18 from the pin 20. This is followed by rotating the upper assembly 14 about the pin 16 away from the lower assembly 12 as indicated by an arrow in FIG. 2. In this condition, the drum 30 is accessible from above for removing it from the lower assembly 12 as will be described. Also, the process kit made up of the developing unit 42 and cleaning unit 54 may be removed from the upper assembly 14.

Hereinafter will be described in detail the latches 34*a* and 34*b* for retaining the drum 30 on the framework of the copier 10 as well as a construction which is associated with the latches 34*a* and 34*b*.

Referring to FIG. 3, the latches 34*a* and 34*b* are rotatably supported by the support plates 26*a* and 26*b* by pins 64*a* and 64*b*, respectively. Arms 66*a* and 66*b* extend from the latches 34*a* and 34*b*, respectively. The arms 66*a* and 66*b* are respectively movably received in slots 68*a* and 68*b* which are formed through the support plates 26*a* and 26*b*. It is to be noted that the arm 66*b* of the rear latch 34*b* and its associated slot 68*b* are not shown in FIG. 3. Biasing members in the form of coiled compression springs 70*a* and 70*b* are respectively preloaded between the arms 66*a* and 66*b* and the support plates 26*a* and 26*b* so as to constantly urge the arms 66*a* and 66*b*, and therefore the latches 34*a* and 34*b*, toward the recesses 28*a* and 28*b* of their associated support plates 26*a* and 26*b*. In this construction, the drum 30 is usually pressed at its opposite ends by the latches 34*a* and 34*b* from above as viewed in FIGS. 1 and 2 and thereby prevented from slipping out of the body of the copier 10.

In the event of removal of the drum 30 from the lower assembly 12, directly touching the drum 30 would bring about various problems as stated earlier. In the structure shown in FIG. 3, it is necessary to release the shaft 32 of the drum 30 from the latches 34*a* and 34*b*. When the drum 30 is removed and then replaced with another or loaded again in the body of the copier 10, the operator's hands should be kept from the drum 30 for the previously described reasons. This also holds true when the copier 10 is assembled and when the drum 30 is mounted in the body of the copier 10.

To meet the above requirements, a holder device in accordance with the present invention is used. The holder device has a function of dismounting an image carrier from the body of an image forming apparatus and a function of mounting it on the same. The device of the present invention comprises a unique holder for grasping and retaining an image carrier. A reference will be made to FIGS. 4A to 4C for describing a preferred embodiment of the holder device in accordance with the present invention. The following description will concentrate on a case wherein the drum 30 whose service life has expired is to be replaced with a new drum 30A.

Figure 4A:
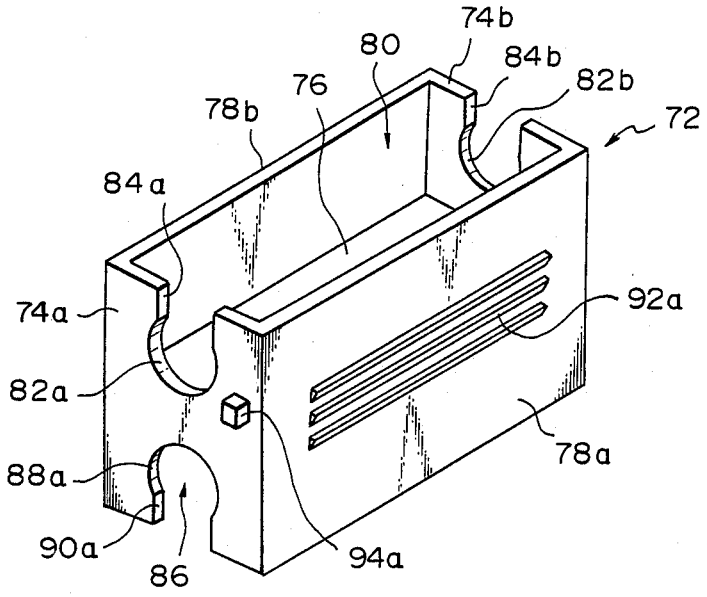
FIG. 4A is a perspective view of a holder device embodying the present invention.
Figure 4B:
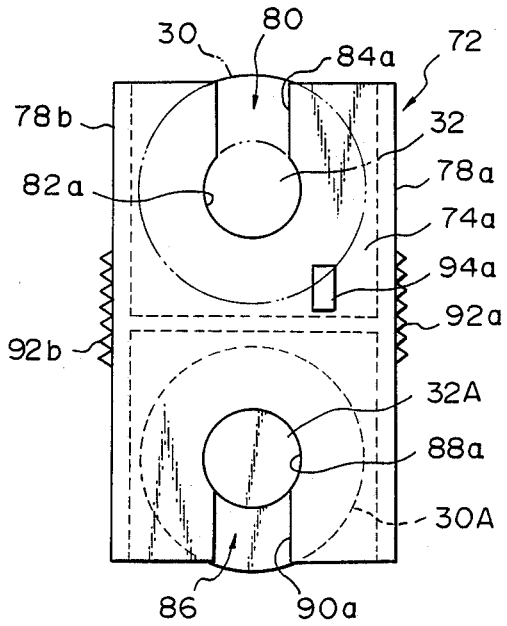
FIG. 4B is a front view of the holder device shown in FIG. 4A.
Figure 4C:
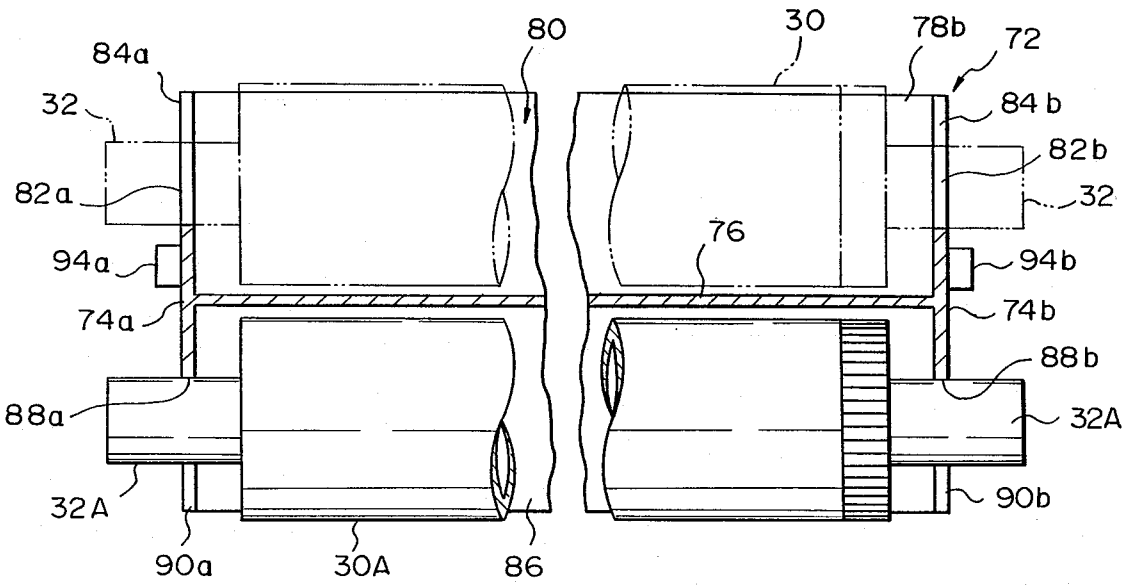
FIG. 4C is a vertical section of the holder device.

In FIGS. 4A to 4C, a holder 72 is made up of a front end wall 74*a*, a rear end wall 74*b*, a wall 76 interconnecting the front and rear walls 74*a* and 74*b*, and a pair of side walls 78*a* and 78*b*. These walls 74*a*, 74*b*, 76, 78*a* and 78*b* in cooperation define a first space 80 and a second space 86 on the opposite sides of the wall 76. The front end wall 74*a* is provided with an opening 82*a* and a guide slot 84*a* which is contiguous with the opening 82*a* and has a width smaller than the diameter of the opening 82*a*, the guide slot 84*a* being open at its upper end as viewed in FIGS. 4A to 4C. Likewise, the rear end wall 74*b* is provided with an opening 82*b* and a guide slot 84*b* which are identical in configuration with the opening 82*a* and guide slot 84*a*. The openings 82*a* and 82*b* are adapted to receive and retain opposite ends of the drum shaft 32. A new drum 30A to replace the old drum 30 is accommodated in the second space 86 of the holder 72. More specifically, opposite ends of the new drum 30A are individually held in openings 88*a* and 88*b* which are formed through the end walls 74*a* and 74*b*, respectively. Guide slots 90*a* and 90*b* having a width smaller than the diameter of the openings 88*a* and 88*b* are contiguous with the openings 88*a* and 88*b*, respectively. The lower ends of the guide slots 90*a* and 90*b* as viewed in FIGS. 4A to 4C are open.

Usually, the new drum 30A is retained in the second space 86 of the holder 72, but no drum is received in the first space 80. The holder 72 is delivered to a user as a service part in such a condition.

Figure 5A:
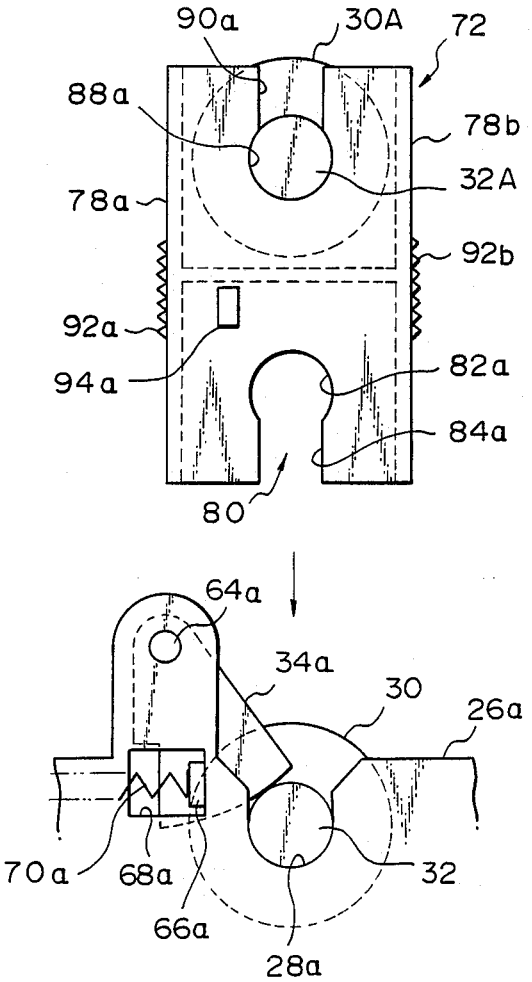
FIGS. 5A to 5C show a sequence of steps for dismounting a photoconductive element from the copier body.

To remove the old drum 30 from the body of the copier 10, the rotatable upper assembly 14 is moved away from the lower assembly 12 to the position shown in FIG. 2. Then, as shown in FIG. 5A, the holder 72 is held by hand and lowered toward the drum 30 which is supported by the lower assembly 12, the first or empty space 80 facing downward. A person can manipulate the holder 72 merely by gripping the side walls 78*a* and 78*b* of the holder 72 and therefore does not have to touch the new drum 30A. The side walls 78*a* and 78*b* are respectively provided with elongate lugs 92*a* and 92*b* for preventing the holder 72 from slipping off the person's hand, thereby promoting the ease of operation.

Figure 5B:
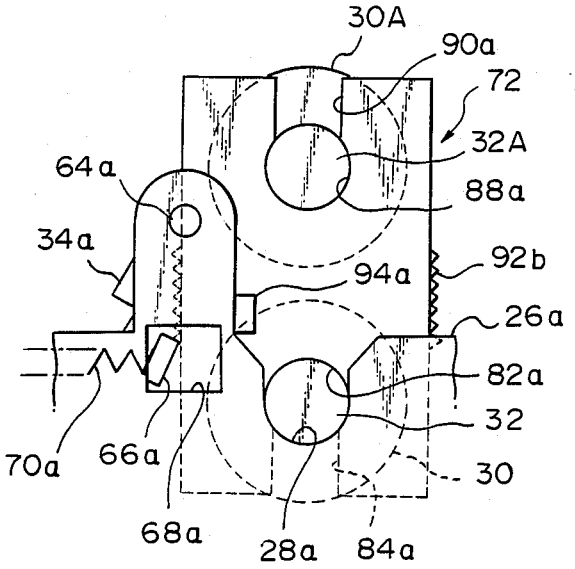

As the holder 72 is lowered until the guide slots 84*a* and 84*b* make contact with the opposite ends of the drum shaft 32, it is urged further downward. At this instant, lugs 94*a* and 94*b* provided on the end walls 74*a* and 74*b*, respectively, abut against and push down the latches 34*a* and 34*b*. As a result, the latches 34*a* and 34*b* are rotated away from the ends of the drum shaft 32 and recesses 28*a* and 28*b*, against the action of the springs 70*a* and 70*b*. More specifically, the lugs 94*a* and 94*b* release the latches 34*a* and 34*b* from the ends of the drum shaft 32 to thereby cancel the restraint on the drum shaft 32. Then, the holder 72 is further lowered until the ends of the drum shaft 32 have been received in the openings 82*a* and 82*b* via the guide slots 84*a* and 84*b* which are elastically yieldable. Consequently, the drum 30 is accommodated in the first space 80 and retained by the openings 82*a* and 82*b*. Such a condition is shown in FIG. 5B.

Figure 5C:
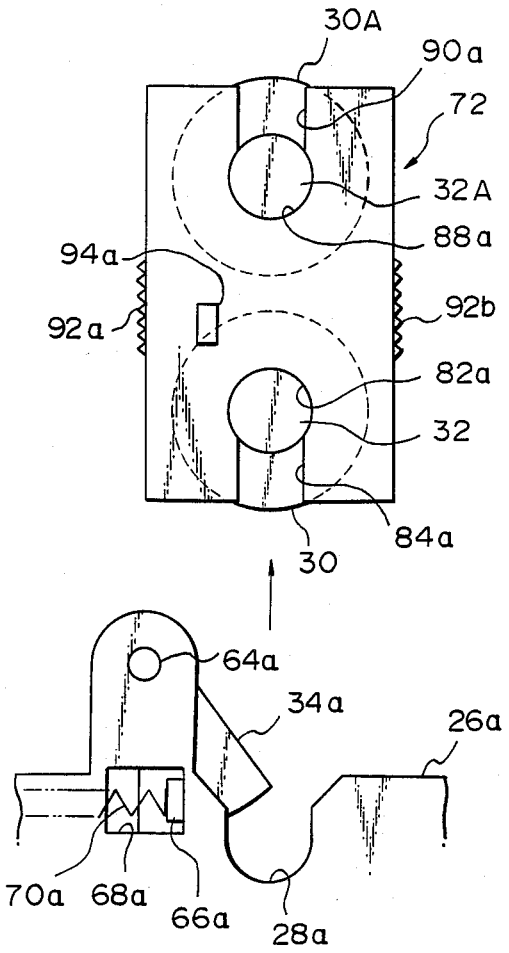

Then, the holder 72 is pulled upward. Since the width of the guide slots 84*a* and 84*b* is smaller than the diameter of the openings 82*a* and 82*b* and since the latches 34*a* and 34*b* are now released from the drum shaft 32, the drum 30 is pulled upward together with the holder 72 while being accommodated in the space 80 and retained by the openings 82*a* and 82*b*. This will be clearly understood from FIG. 5C.

As described above, the latches 34*a* and 34*b* and springs 70*a* and 70*b* constitute means for retaining a photoconductive element, i.e., for preventing the drum 30 from slipping out of the body of the copier 10. On the other hand, the lugs 94*a* and 94*b* constitute means for releasing the drum 30 from the restraint of the restraining means when the drum 30 is to be removed from the body of the copier 10. Further, the openings 82*a* and 82*b* serve as means for retaining the drum 30 which has been mounted on the body of the copier 10.

The function of mounting the new drum 30A on the body of the copier 10 will be described in distinction from the function of dismounting the old drum 30 which has been stated above.

Figure 6A:
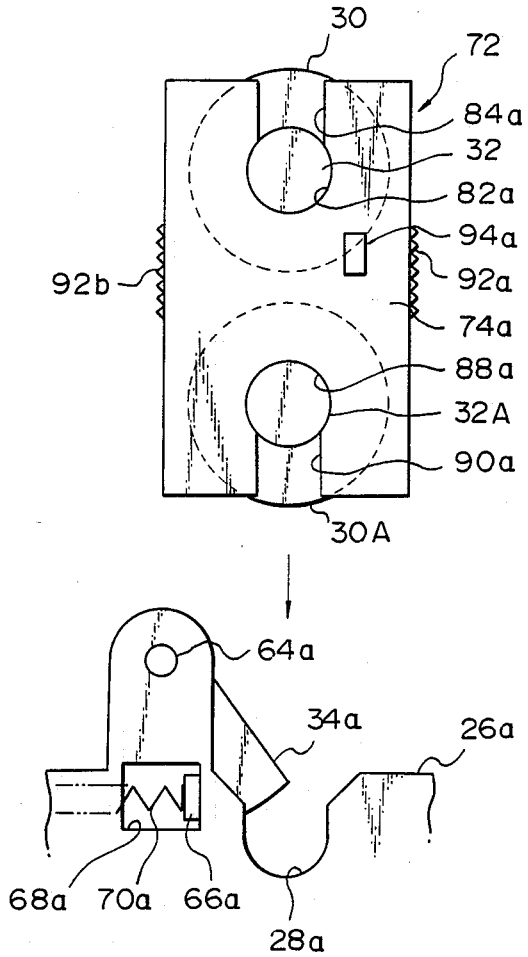
FIGS. 6A to 6C show a sequence of steps for mounting a photoconductive body on the copier body.
Figure 6B:
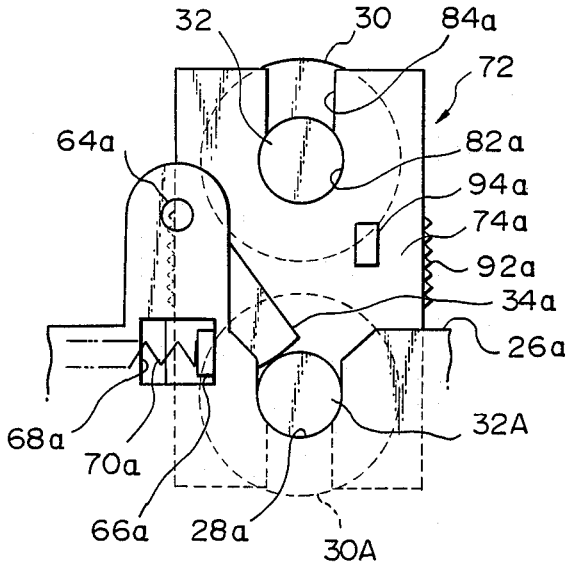
Figure 6C:
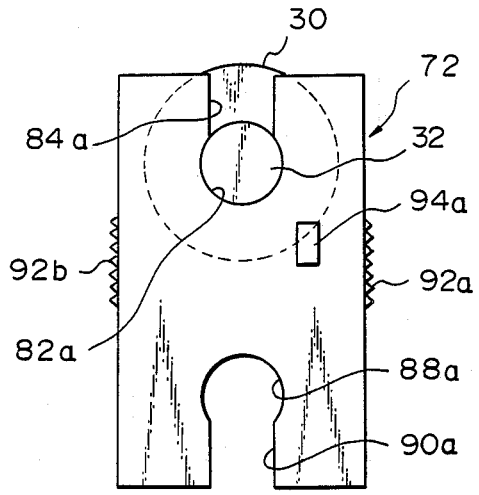
Figure 6C:
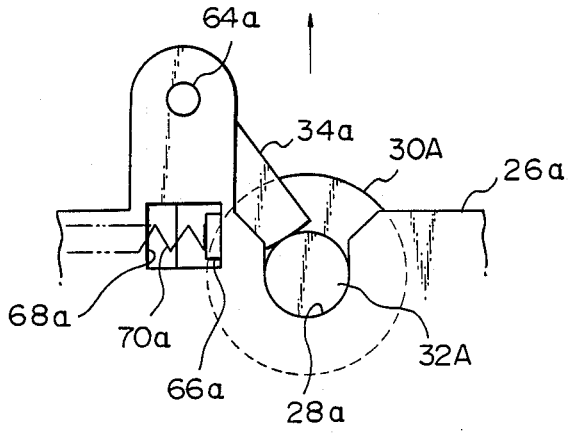

After the old drum 30 has been removed from the body of the copier 10 as discussed above, the holder 72 is turned upside down such that the new drum 30A accommodated in the holder 72 faces downward, as shown in FIG. 6A. Then, the holder 72 is lowered until the opposite ends of a shaft 32A of the drum 30A have been received in the recesses 28*a* and 28*b* of the support plates 26*a* and 26*b*, as shown in FIG. 6B. During such a movement, the ends of the drum shaft 32A individually urge the latches 34*a* and 34*b* against the action of the springs 70*a* and 70*b*. By this procedure, the new drum 30A is securely mounted on the body of the copier 10. In this case, since the lugs 94*a* and 94*b* are absent on those portions of the end walls 74*a* and 74*b* where the drum 30A is retained, the latches 34*a* and 34*b* are respectively urged by the springs 70*a* and 70*b* back to their positions for restraining the opposite ends of the drum shaft 32A as soon as the drum shaft 32A is received in the recesses 28*a* and 28*b*. The latches 34*a* and 34*b* therefore prevent the shaft 32A from moving out of the recesses 28*a* and 28*b*. As shown in FIG. 6C, when the holder 72 is pulled upward with the drum shaft 32A being received in the recesses 28*a* and 28*b*, the drum shaft 32A is removed from the openings 88*a* and 88*b* because the drum 30 is retained by the latches 34*a* and 34*b*. As a result, the drum 30A is left in an operative position on the body of the copier 10. Again, the guide slots 90*a* and 90*b* are elastically yieldable to allow the opposite ends of the drum shaft 32A to move out of the openings 88*a* and 88*b* with ease. After the replacement of the old drum 30 with the new drum 30A, the upper assembly 14 is rotated to the original position shown in FIG. 1. In this condition, the copier 10 is ready to produce copies as desired.

As discussed above, the openings 88*a* and 88*b* of the holder 72 constitute means for removably retaining the drum 30A which is expected to replace the drum 30. The latches 34*a* and 34*b* and springs 70*a* and 70*b* serve as means for restraining the drum 30A from slipping out of the body of the copier 10 when the drum 30A is mounted on the copier 10 by using the holder 72. The drum 30A is mounted on the body of the copier 10 by such restraining means and retaining means.

Figure 7:
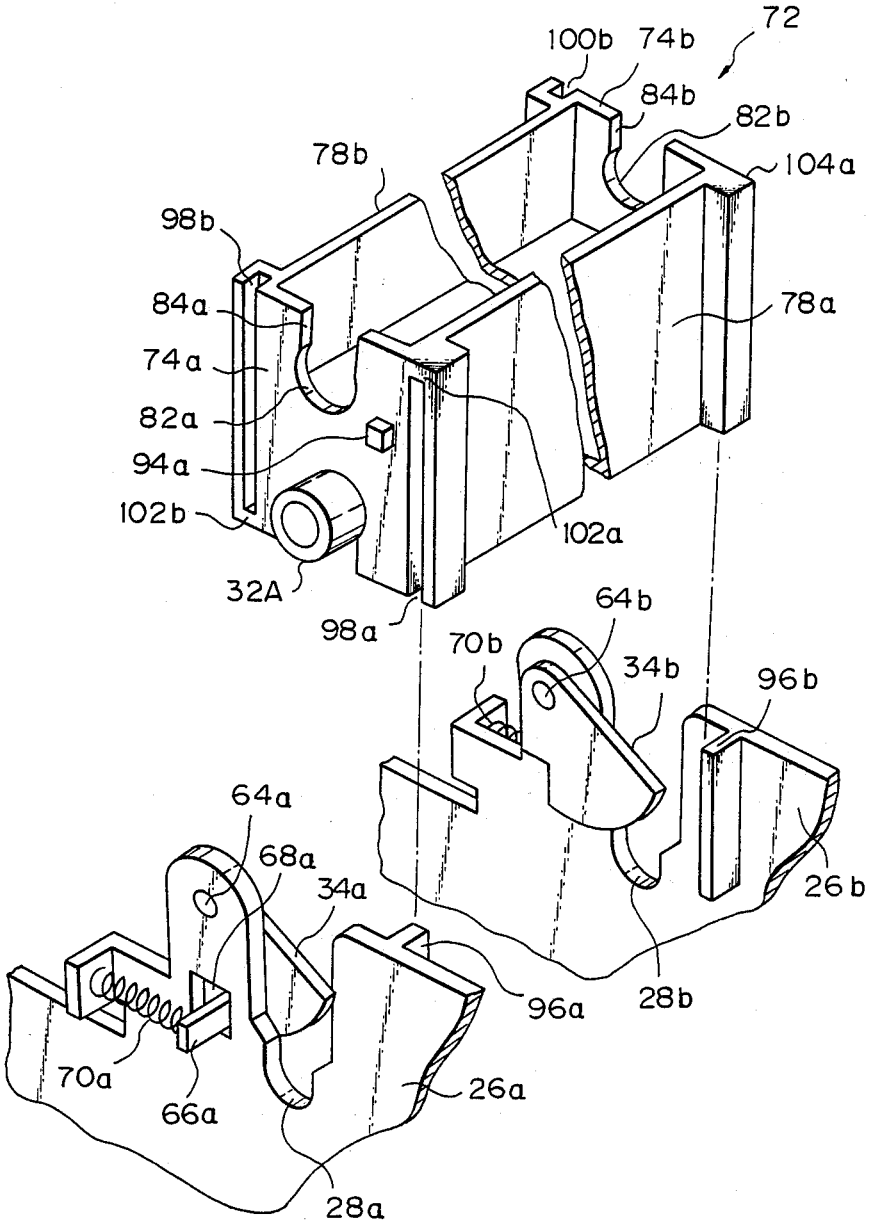
FIG. 7 is a perspective view showing a specific construction of an arrangement for guiding a holder.

Referring to FIG. 7, there is shown an implementation for guiding the holder 72 when the holder 72 is used to replace the drum 30 with the new drum 30A, i.e., such that the guide slots 84*a* and 84*b* of the holder 72 accurately engage the opposite ends of the drum shaft 32 and the drum shaft 32A accurately mates with the recesses 28*a* and 28*b* of the support plates 26*a* and 26*b*. As shown, the implementation comprises facing rail members 96*a* and 96*b* provided on the support plates 26*a* and 26*b*, channels 98*a* and 98*b* and 100*a* and 100*b* (not shown) respectively provided on the end walls 74*a* and 74*b* of the holder 72 for slidably mating with the rail members 96*a* and 96*b*, and stops 102*a* and 102*b* and 104*a* and 104*b* (not shown) at which the channels 98*a* and 98*b* and 100*a* and 100*b* terminate, respectively. The holder 72 is correctly positioned relative to the body of the copier 10 when the channels 98*a* and 100*a* or the channels 98*b* and 100*b* are mated with the channel members 96*a* and 96*b*, respectively. The stops 102*a* and 102*b* on the end plate 74*a* and the stops 104*a* and 104*b* on the end plate 74*b* are positioned in opposite relation to each other so as to restrain the holder 72 from being loaded in an incorrect orientation. More specifically, when the holder 72 is lowered toward the body of the copier 10 with its front and rear ends reversed, the stops 104*a* and 104 and the stops 102*a* and 102*b* prevent the rail members 96*a* and 96*b* from mating with the channels 100*a* and 100*b* or the channels 98*a* and 98*b*.

The guide arrangement described above with reference to FIG. 7 will be of great help for ordinary users although it may not always be necessary for skilled users.

Figure 8:
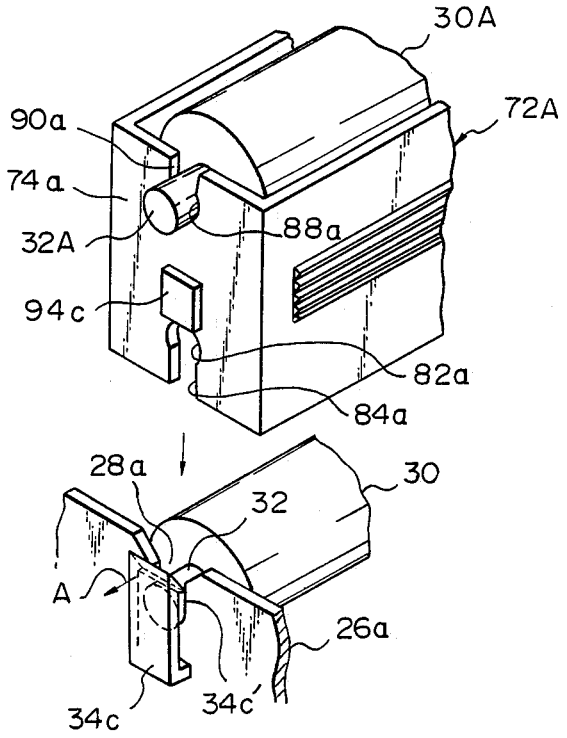
FIG. 8 is a perspective view representative of an alternative construction of releasing means.

Referring to FIG. 8, there is shown an alternative to the arrangement of the restraining means which includes the latches 34*a* and 34*b* and springs 70*a* and 70*b*. In the figure, a latch 34*c* is provided integrally with the support plate 26*a* of the copier body. Needless to say, a latch 34*d* having the same configuration as the latch 34*c* is provided integrally with the other support plate 26*b* which is not shown in FIG. 8. The latch 34*c* is positioned outwardly of the recess 28*a* and faces the recess 28*a*. A pawl 34*c*' protrudes from the upper end of the latch 34*c*. The pawl 34*c*' engages one end of the shaft 32 of the drum 30 which is mounted on the body of the copier 10, thereby preventing the drum 30 from slipping out of the body of the copier 10. A holder 72A is essentially similar to the holder 72 of the previous embodiment except that lugs 94*c* and 94*d* are provided on its end walls 74*a* and 74*b* above the openings 82*a* and 82*b* for freeing the drum 30 from restraint.

To remove the drum 30 from the body of the copier 10, the holder 72A is lowered by hand toward the drum 30 as in the first embodiment. While the holder 72 is so lowered, the lugs 94*c* and 94*c* abut against the tops of their associated latches 34*c* and 34*d* and cause them to elastically deform outward as indicated by an arrow A in the figure, thereby releasing the latches 34*c* and 34*d* from the opposite ends of the drum shaft 32. After the openings 82*a* and 82*b* have mated with the opposite ends of the drum shaft 32, the holder 72A is raised to remove the drum 30 from the body of the copier 10. To mount the new drum 30A, the above procedure is performed in the reverse sequence. Specifically, after the holder 72A has been turned upside down from the position of FIG. 8, it is lowered so that the opposite ends of the shaft 32A of the drum 30A are received in their associated recesses 28*a* and 28*b* while elastically deforming the latches 34*a* and 34*d* in the direction A. Since the lugs 94*c* and 94*d* do not make contact with the latches 34*c* and 34*d*, the latches 34*c* and 34*d* individually engage and retain the opposite ends of the drum shaft 32A and thereby restrain the drum 30A from moving out of the body of the copier 10. Hence, the drum 30A is left on the body of the copier 10 when the holder 72A is pulled upward. As stated above, the restraining means of this alternative embodiment is implemented by the latches 34*c* and 34*d* only.

Figure 9:
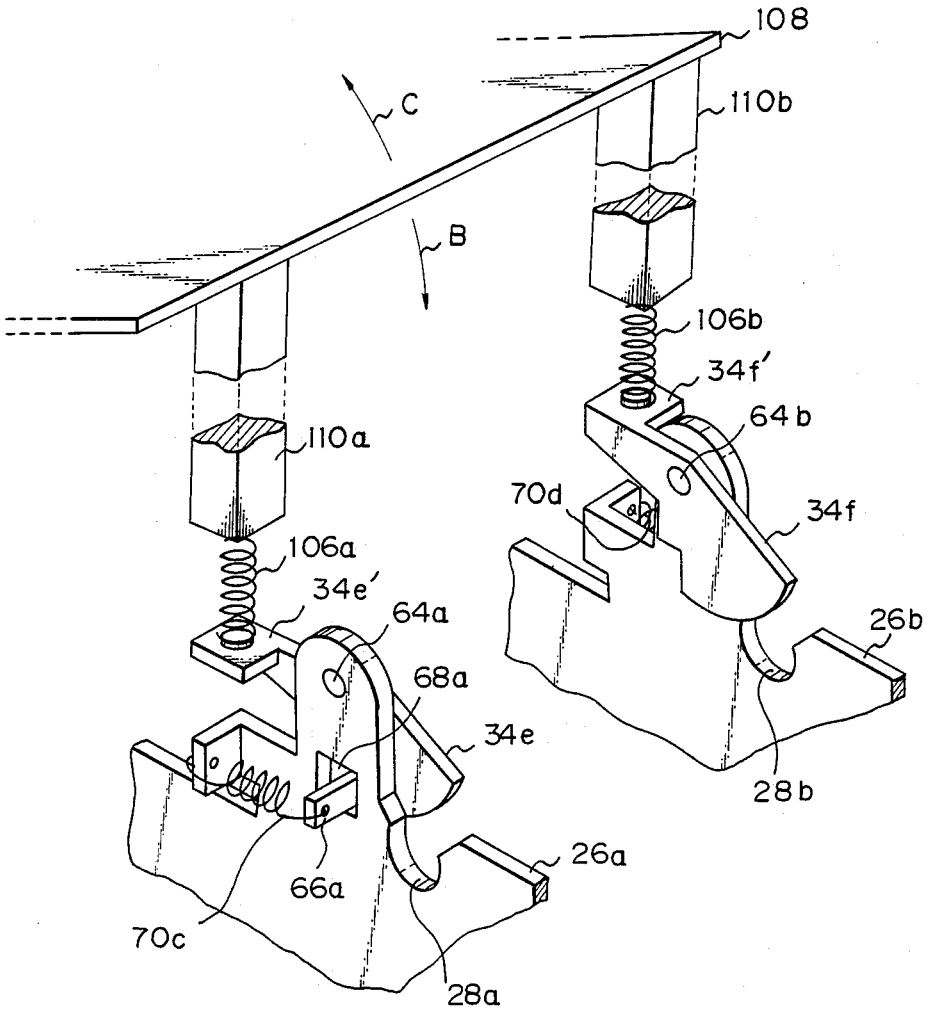
FIG. 9 is a perspective view showing another alternative construction of the releasing means.

FIG. 9 shows an alternative construction of the releasing means for freeing the photoconductive element from the restraint of the restraining means. In this alternative construction, the releasing means is interlocked with a top cover of the body of the copier 10 which is opened and closed as needed. As shown, latches 34*e* and 34*f* include spring seat portions 34*e*' and 34*f*', respectively. Compression springs 106*a* and 106 are securely seated on the spring seat portions 34*e*' and 34*f*', respectively. Pressing members 110*a* and 110*b* extend downward from the top cover 108 in association with the springs 106*a* and 106*b*, respectively. Tension springs 70*c* and 70*d* are respectively preloaded between the latches 34*e* and 34*f* and the support plates 26*a* and 26*b* in place of the compression springs 70*a* and 70*b* of the previous embodiment, whereby the latches 34*e* and 34*f* are constantly biased in a direction for freeing the photoconductive element from restraint. When the top cover 108 is closed in a direction indicated by an arrow B in FIG. 9, the pressing members 110*a* and 110*b* urge respectively the spring seat portions 34*e*' and 34*f*' of the latches 34*e* and 34*f* via the springs 106*a* and 106*b*. In this condition, the latches 34*e* and 34*f* restrain the photoconductive element against the force of their associated tension springs 70*c* and 70*d*. As the top cover 108 and therefore the pressing members 110*a* and 110*b* are raised as indicated by an arrow C, the latches 34*e* and 34*f* are released from the photoconductive element by the tension springs 70*c* and 70*d*.

Figure 10A:
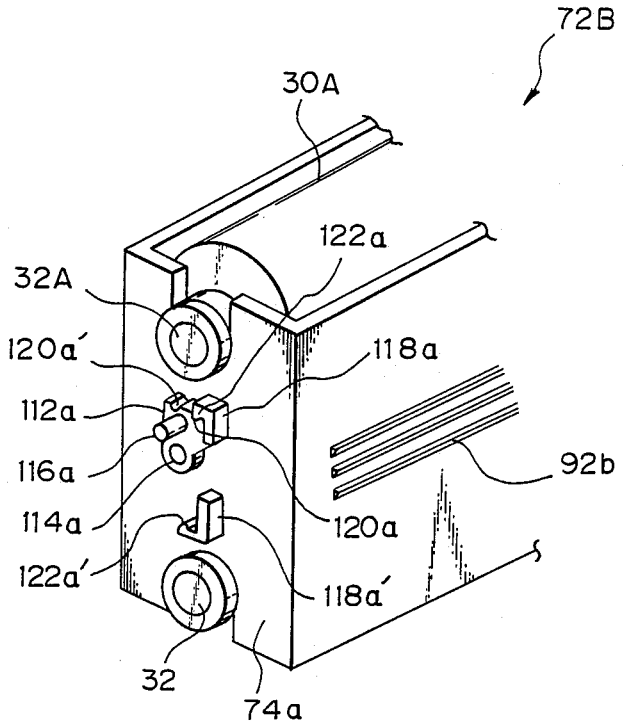
FIGS. 10A and 10B are views showing a farter alternative construction of the releasing means.
Figure 10B:
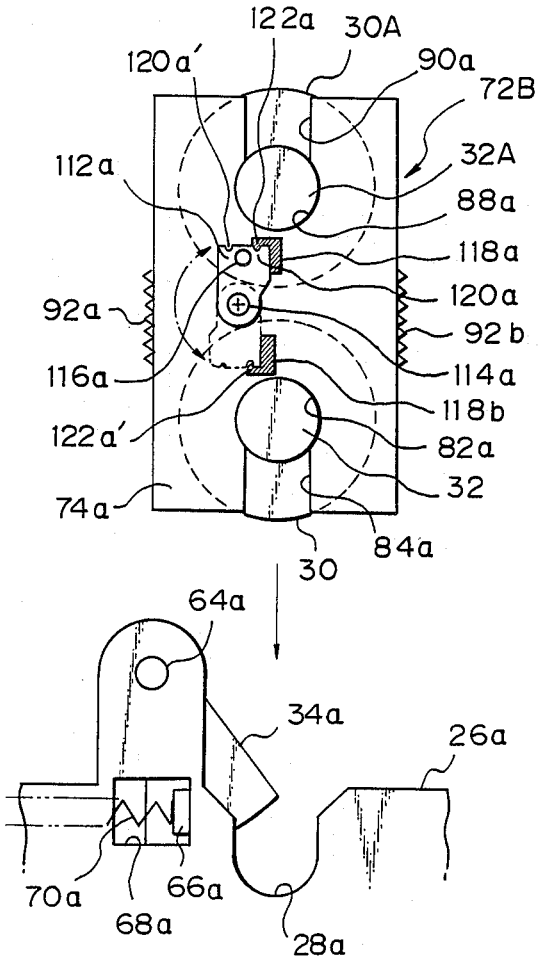

Referring to FIGS. 10A and 10B, still another alternative construction of the releasing means is shown which is useful in the event that the photoconductive element is first dismounted from the body of the copier 10 for removing a jamming sheet and then mounted on the same again. As shown, stubs 114*a* and 114*b* (not shown) are respectively provided on the end walls 74*a* and 74*b* of a holder 72B. Pieces 112*a* and 112*b* (not shown) are rotatable about the stubs 114*a* and 114*b*, respectively. Knobs 116*a* and 116*b* (not shown) extend from the rotatable pieces 112*a* and 112*b*, respectively, so as to facilitate the manipulation of the latter. Also provided on the end walls 74*a* and 74*b* are a pair of stops 118*a* and 118*a*' and a pair of stops 118*b* and 118*b*' (not shown), respectively. The stops 118*a* and 118*a*' and the stops 118*b* and 118*b*' are individually positioned substantially symmetically to each other with respect to their associated stubs 114*a* and 114*b*, so that the rotatable pieces 112*a* and 112*b* are individually rotatable between the stops 118*a* and 118*a*' and the stops 118*b* and 118*b* ' by an angle of 180 degrees only each. The rotatable pieces 112*a* and 112*b* are respectively formed with recesses 120*a* and 120*a*' and recesses 120*b* and 120*b*' (not shown) in their portions which are engageable with their associated stops 118*a* and 118*a*' and 118*b* and 118*b*'. On the other hand, the stops 118*a* and 118*a*' and the stops 118*b* and 118*b*' are respectively formed with projections 122*a* and 122*a*' and projections 122*b* and 122*b*' (not shown) which are respectively engageable with the recesses 120*a* and 120*a*' and 120*b* and 120*b*', respectively. The recesses 120*a* an 120*a*' and 120*b* and 120*b*' and the projections 122*a* and 122*a*' and 122*b* and 122*b*' cooperated so that their associated rotatable pieces 112*a* and 112*b* may be held in positions which are regulated by the stops 118*a* and 118*a*' and 118*b* and 118*b*', respectively. When the rotatable pieces 112*a* and 112*b* are respectively retained by their associates stops 118*a*' and 118*b*' in a position indicated by a dashed line in FIG. 10B, they push away their associated latches 34*a* and 34*b* to allow the photoconductive element to be removed for picking out a jamming sheet, for example. Conversely, while the rotatable pieces 112*a* and 112*b* are held in a position indicated by a solid line by their associated stops 118*a* and 118*b*, they do not push away the latches 34*a* and 34*b* so that the removed photoconductive element can be mounted again after the removal of a jamming sheet.

Figure 11A:
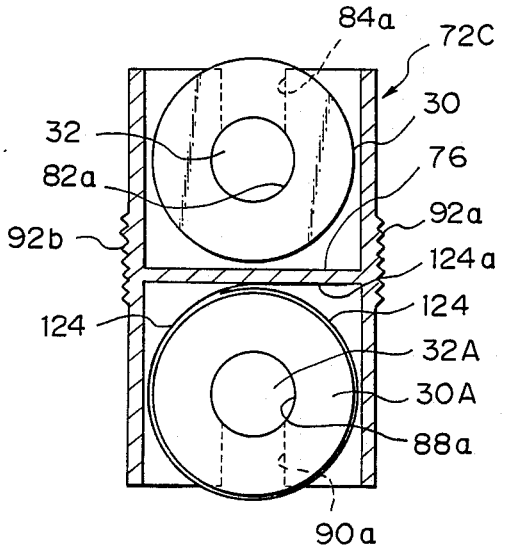
FIG. 11A is a horizontal section of a holder which includes a screening sheet for intercepting ambient light.
Figure 11B:
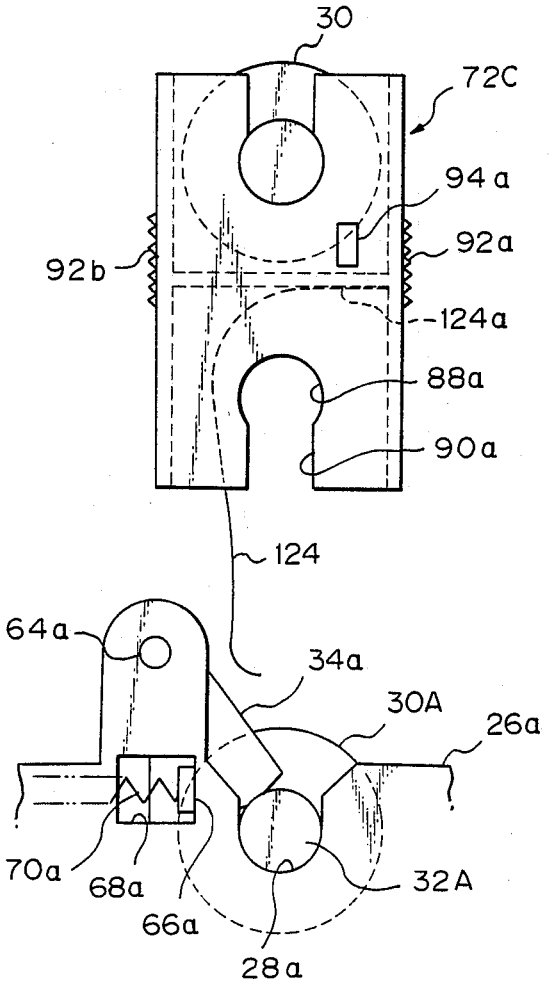
FIG. 11B shows how the screening sheet of FIG. 11A is removed from a photoconductive element.

Generally, a photoconductive element has to be kept not only from the operator's hand but also from ambient light which would deteriorate the photoconductive element. Especially a fresh photoconductive element has to be protected from ambient light. Another embodiment of the present invention which meets this requirement is shown in FIGS. 11A and 11B.

Any of the holders 72, 72A and 72B shown and described retains a fresh drum 30A therein. A holder 72C shown in FIGS. 11A and 11B is provided with a screening member 124 in the form of a sheet such as an opaque black sheet for protecting the drum 30A from ambient light. More specifically, the sheet 124 is wrapped around the drum 30A and rigidly connected at a part thereof, e.g., at one end 124*a* as shown in the figures, to a suitable portion of the holder 72C such as the connecting wall 76. The drum 30A is received in the recesses 28*a* and 28*b* of the support plates 26*a* and 26*b* in exactly the same manner as the drum 30A of FIGS. 6A to 6C. As the holder 72C is raised with the drum 30A being received in the recesses 28*a* and 28*b*, the screening sheet 124 is sequentially removed from the drum 30A to uncover the surface of the drum 30A, as shown in FIG. 11B. Thereafter, the upper assembly 14 shown in FIGS. 1 and 2 is rotated to its position for cooperating with the lower assembly 12. In this manner, the fresh drum 30A is continuously covered with the screening sheet 124 until it assumes an operative position in the body of the copier 10 and is thereby protected from ambient light.

While the illustrative embodiments of the present invention have been shown and described in relation to an exemplary case wherein an old image carrier or photoconductive element is to be removed and replaced with a new image carrier, it will be apparent that they are applicable even to a production stage for mounting an image carrier on an image forming apparatus.

In any of the embodiments, a single holder implements both of a function of dismounting an image carrier from the body of an image forming apparatus and a function of mounting it on the same. Alternatively, a holder having the dismounting function and a holder having the mounting function may be produced independently of each other and may each be provided with predetermined extra parts and elements.

Further, an image carrier to which the present invention pertains is not limited to a photoconductive element and may alternatively be implemented as an image carrier having a dielectric layer, for example. The substrate of an image carrier may be comprised of either a rigid member such as an aluminum drum or a so-called soft image carrier which consists of a foamed material and a foil of nickel or similar metal provided on the outer periphery of the foamed material, the surface of the soft image carrier having resilience. Any of the embodiments of the present invention is especially useful with such a soft image carrier whose surface is inherently susceptible to scratches. The embodiments shown and described may of course be used to handle some parts which are not pleasant to touch.

In summary, it will be seen that the present invention allows a person to mount and dismount an image carrier on the body of an image forming apparatus as desired without touching the image carrier and therefore without the fear of toner smearing the hands and clothes or of scratching or otherwise damaging the image carrier. Such an operation is simple enough even for an ordinary user to perform. Since the image carrier is replaceable independently of the other structural parts and elements, economic losses particular to the prior art process kit scheme are eliminated. In addition, it is not necessary to provide an image carrier with a grip which would constitute a hinderence.

Various modifications will become possible for those skilled in the art after receiving the teachings of the present disclosure without departing from the scope thereof.

What is claimed is:

1. A holder device for handling an image carrier which is used with an image forming apparatus, comprising:

a housing defining a space for accommodating said image carrier and provided with an open portion for mounting and dismounting said image carrier from said space; and image carrier support means provided on said housing for detachably supporting said image carrier when said image carrier is accommodated in said housing, wherein said image carrier support means comprises grasping means for grasping and guiding opposite ends of a shaft on which said image carrier is mounted, and retaining means for detachably retaining said opposite ends of said shaft.

2. A holder device as claimed in claim 1, wherein said housing comprises a pair of opposite end walls and a pair of opposite side walls which cooperate to define said space.

3. A holder device as claimed in claim 2, wherein said grasping means comprise guide slots each being formed through a respective one of said end walls for guiding opposite ends of said shaft when said image carrier moves through said open portion, and said retaining means comprises openings in said end walls, each being contiguous with a respective one of said guide slots for retaining the opposite ends of said shaft when said image carrier is received in said space.

4. A holder device as claimed in claim 2, wherein said housing further comprises a connecting wall which interconnects said end walls within said space and partitions said space into two independent compartments each having an open end so as to define two of said open portions, each of said end walls being provided with a pair of said grasping means and a pair of said retaining means so that said image carrier may be introduced into any one of said compartments through a respective one of said open ends which is associated with said compartment.

5. A holder device as claimed in claim 4, wherein one of said compartments accommodates and retains an image carrier dismounted from said image forming apparatus while the other compartment accommodates and retains a new image carrier to be mounted in said image forming apparatus.

6. A holder device as claimed in claim 2, wherein said image forming apparatus comprises a pair of support plates each having a support portion for supporting one of opposite ends of said shaft and restraining means for preventing said image carrier supported by said support plates from slipping out of said support plates, said holder device further comprising releasing means for releasing said image carrier from restraint of said restraining means.

7. A holder device as claimed in claim 6, wherein said restraining means comprises latch members each being rotatably supported by a respective one of said support plates and spring means for individually rotating said latch members such that said latch members restrain the opposite ends of said image carrier which is supported by said support portions, said releasing means comprising lug members individually provided on said end walls of said housing for disengaging said latch members against the action of said spring members as said grasping means grasp and guide the end portions of said shaft.

8. A holder device as claimed in claim 6, wherein said restraining means comprise elastic latch members each being provided on a respective one of said support portions of said support plates and each including a pawl for locking one end of said shaft in position, said releasing means comprising lug members individually provided on said end plates of said housing for releasing said pawls of said latch members as said grasping means grasp and guide the opposite ends of said shaft.

9. A holder device as claimed in claim 7, wherein said housing further comprises a connecting wall which interconnects said end walls within said space and partitions said space into two independent compartments each having an open end so as to define two of said end portions, each of said end walls being provided with a pair of said grasping means and a pair of said retaining means so that said image carrier may be introduced into any of said compartments through one of said open ends which is associated with said compartment, said lug members being individually rotatable on said end walls, said releasing means further comprising a pair of regulating members provided on each of said end walls for selectively freeing regulating rotation of said rotatable lug members in such a manner as to stop each of said lug members in predetermined positions, thereby selectively freeing said image carriers received in said compartments.

10. A holder device as claimed in claim 9, wherein said releasing means further comprises positioning means provided on each of said end plates for accurately positioning said lug members at said predetermined positions.

11. A holder device as claimed in claim 10, wherein said positioning means each comprises recesses formed in said lug member and projections provided on said respective regulating members and engageable with said recesses after said lug member has been stopped.

12. A holder device as claimed in claim 2, wherein said image forming apparatus comprises a pair of support plates each having a support portion for supporting one of opposite ends of a shaft on which said image carrier is mounted, restraining means for preventing said image carrier supported by said support portions from slipping out of said support portions, and a top cover having means for releasing said image carrier from restraint of said restraining means when opened.

13. A holder device as claimed in claim 2, further comprising holder guiding means for guiding said holder device into an image carrier mounting section of said image forming apparatus.

14. A holder device as claimed in claim 13, wherein said image forming means comprises a pair of support plates for supporting one of opposite ends of a shaft on which said image carrier is mounted each, said holder guiding means comprising rail members individually provided on one of said support plates and end plates, and recesses provided on the other of said support plates and end plates to slidably mate with said rail members.

15. A holder device as claimed in claim 2, further comprising slip preventing means provided on said housing.

16. A holder device as claimed in claim 15, wherein said slip preventing means comprises a plurality of elongate ridges which extend on each of said end plates of said housing.

17. A holder device as claimed in claim 2, further comprising screening means for isolating said image carrier received in said space from ambient light.

18. A holder device as claimed in claim 17, wherein said screening means comprises an opaque screening sheet which covers said image carrier which is received in said space.

19. A holder device as claimed in claim 18, wherein one end of said screening sheet is rigidly connected to a part of said housing, whereby said screening sheet is removed from said image carrier when said image carrier is moved from said housing.

20. A holder device as claimed in claim 5, wherein said image forming apparatus comprises a pair of support plates each having a support portion for supporting one of opposite ends of said shaft and restraining means for preventing said image carrier supported by said support plates from slipping out of said support plates, said holder device further comprising releasing means for releasing said image carrier from restraint of said restraining means.

21. A holder device as claimed in claim 20, wherein said releasing means comprise lug members on portions of said end walls defining said one of said compartments.

22. A holder device as claimed in claim 12, wherein said restraining means comprise a plurality of spring loaded latches and said releasing means comprise means movable with the top cover and operatively engageable with said latches.

23. A holder device for handling an image carrier used with an image forming apparatus, comprising:

a housing defining two compartments, each of said compartments communicating with an open portion of said housing and forming a space for accommodating an image carrier;

image carrier support means provided on said housing for detachably supporting an image carrier accommodating in either one of said two compartments, said support means comprising grasping means for grasping and guiding a shaft on which the image carrier is mounted and retaining means for detachably retaining the shaft, wherein separate sets of said grasping means and said retaining means are provided on said housing at portions of said housing defining each of said two compartments so that both of said compartments may simultaneously house image carrier.

24. A holder device as claimed in claim 23 including releasing means provided on a portion of said housing defining only one of said compartments and cooperating with said image forming apparatus for releasing an image carrier restrained in said image forming apparatus.

* * * * *